US007352655B2

(12) United States Patent
Hjelmeland

(10) Patent No.: US 7,352,655 B2
(45) Date of Patent: Apr. 1, 2008

(54) METHOD AND APPARATUS FOR AUTOMATIC TIME CORRECTION OF A MECHANICAL CLOCK

(75) Inventor: Robert W. Hjelmeland, Kempton, IN (US)

(73) Assignee: Delphi Technologies, Inc., Troy, MI (US)

( * ) Notice: Subject to any disclaimer, the term of this patent is extended or adjusted under 35 U.S.C. 154(b) by 316 days.

(21) Appl. No.: 11/131,399

(22) Filed: May 17, 2005

(65) Prior Publication Data

US 2006/0262650 A1 Nov. 23, 2006

(51) Int. Cl.
*G04C 11/02* (2006.01)
*G04C 13/10* (2006.01)

(52) U.S. Cl. ..... 368/47; 368/60

(58) Field of Classification Search ..... 368/46–61
See application file for complete search history.

(56) References Cited

U.S. PATENT DOCUMENTS

| | | | | |
|---|---|---|---|---|
| 2,248,164 | A * | 7/1941 | Dicke | 368/56 |
| 3,732,685 | A * | 5/1973 | Haydon | 368/60 |
| 2003/0174584 | A1 * | 9/2003 | Fujisawa et al. | 368/47 |
| 2005/0018543 | A1 * | 1/2005 | Fujisawa | 368/47 |
| 2005/0152224 | A1 * | 7/2005 | Shin et al. | 368/47 |

* cited by examiner

*Primary Examiner*—P. Austin Bradley
*Assistant Examiner*—Thanh S Phan
(74) *Attorney, Agent, or Firm*—Jimmy L. Funke

(57) ABSTRACT

A mechanical clock arrangement includes a linkage apparatus rotatingly driving an hour hand and/or a minute hand of a mechanical clock. A sensing device senses a time of day displayed by the mechanical clock. A control device is in communication with both the sensing device and a source of an actual time of day. The control device actuates the linkage apparatus to thereby cause the time of day displayed by the mechanical clock to correspond to the actual time of day.

16 Claims, 4 Drawing Sheets

METHOD AND APPARATUS FOR AUTOMATIC TIME CORRECTION OF A MECHANICAL CLOCK

TECHNICAL BACKGROUND

The present invention relates to a mechanical clock, and, more particularly, to correcting the time displayed by a mechanical clock.

BACKGROUND OF THE INVENTION

The analog mechanical clock had been a staple in automobiles for years prior to the advent and popularity of digital clocks. A problem with such analog clocks is that they suffered from notoriously inaccurate time keeping. The analog clock is typically driven by a stepper motor whose operation is governed by a relatively low frequency crystal oscillator. The instability of such low frequency oscillators may result in inaccuracy in time keeping of plus or minus four seconds per day. Another problem with analog clocks that they constantly drew a relatively large current from the vehicle's battery.

The digital clock, often included as a feature in the radio, has better time keeping accuracy and lower current draw than an analog clock. The microprocessor-based digital clock may use a higher frequency crystal oscillator that is more stable than the lower frequency oscillators that must be used with stepper motors. The higher stability of the oscillator results in more accurate time keeping, with a level of inaccuracy of only about 0.25 second per day. A problem with a digital clock, however, is that it may limit the styling options for the design of the passenger compartment of the vehicle. Moreover, a digital clock does not spatially indicate time of day, as does an analog clock. Thus, reading time from a digital clock may require slightly more cognitive activity by the driver, and may distract the driver from the task at hand, i.e., driving the vehicle.

Vehicle designers and consumers have expressed an interest in reviving the use of analog clocks in modern day vehicles. However, today's consumers will not tolerate the inaccurate time keeping associated with previous generations of mechanical clocks.

What is needed in the art is a mechanical clock for use in an automobile that has the same level of time keeping accuracy that is associated with digital clocks.

SUMMARY OF THE INVENTION

The present invention provides a mechanical clock arrangement that senses the time of day displayed by a mechanical clock and moves the hour hand and/or minute hand to more correctly display an actual time of day. The actual time of day may be received from a digital processor, as with a digital clock, or may be received from some air-borne signal, such as a radio signal or a global positioning system (GPS) signal.

The invention comprises, in one form thereof, a mechanical clock arrangement including a linkage apparatus rotatingly driving an hour hand and/or a minute hand of a mechanical clock. A sensing device senses a time of day displayed by the mechanical clock. A control device is in communication with both the sensing device and a source of an actual time of day. The control device actuates the linkage apparatus to thereby cause the time of day displayed by the mechanical clock to correspond to the actual time of day.

The invention comprises, in another form thereof, a method of operating a mechanical clock, including sensing a time of day displayed by the mechanical clock. The sensing is performed by a sensing device. An actual time of day is received in electronic form. A linkage apparatus of the mechanical clock is actuated to thereby cause the time of day displayed by the mechanical clock to correspond to the actual time of day. The actuating is performed by a control device.

An advantage of the present invention is that the time of day displayed by the mechanical clock is more accurate than with previous mechanical clocks used in automotive applications.

Another advantage is that the standby current may be greatly reduced by disabling the clock while the key is out of the ignition.

Yet another advantage is that there is no need for pin hole controls as typically required with known mechanical clocks.

A further advantage is that the time of day displayed by the mechanical clock may be automatically set based upon an actual time of day received from an external source, such as a GPS signal or a radio signal.

BRIEF DESCRIPTION OF THE DRAWINGS

The above-mentioned and other features and objects of this invention, and the manner of attaining them, will become more apparent and the invention itself will be better understood by reference to the following description of embodiments of the invention taken in conjunction with the accompanying drawings, wherein.

Figure 1:
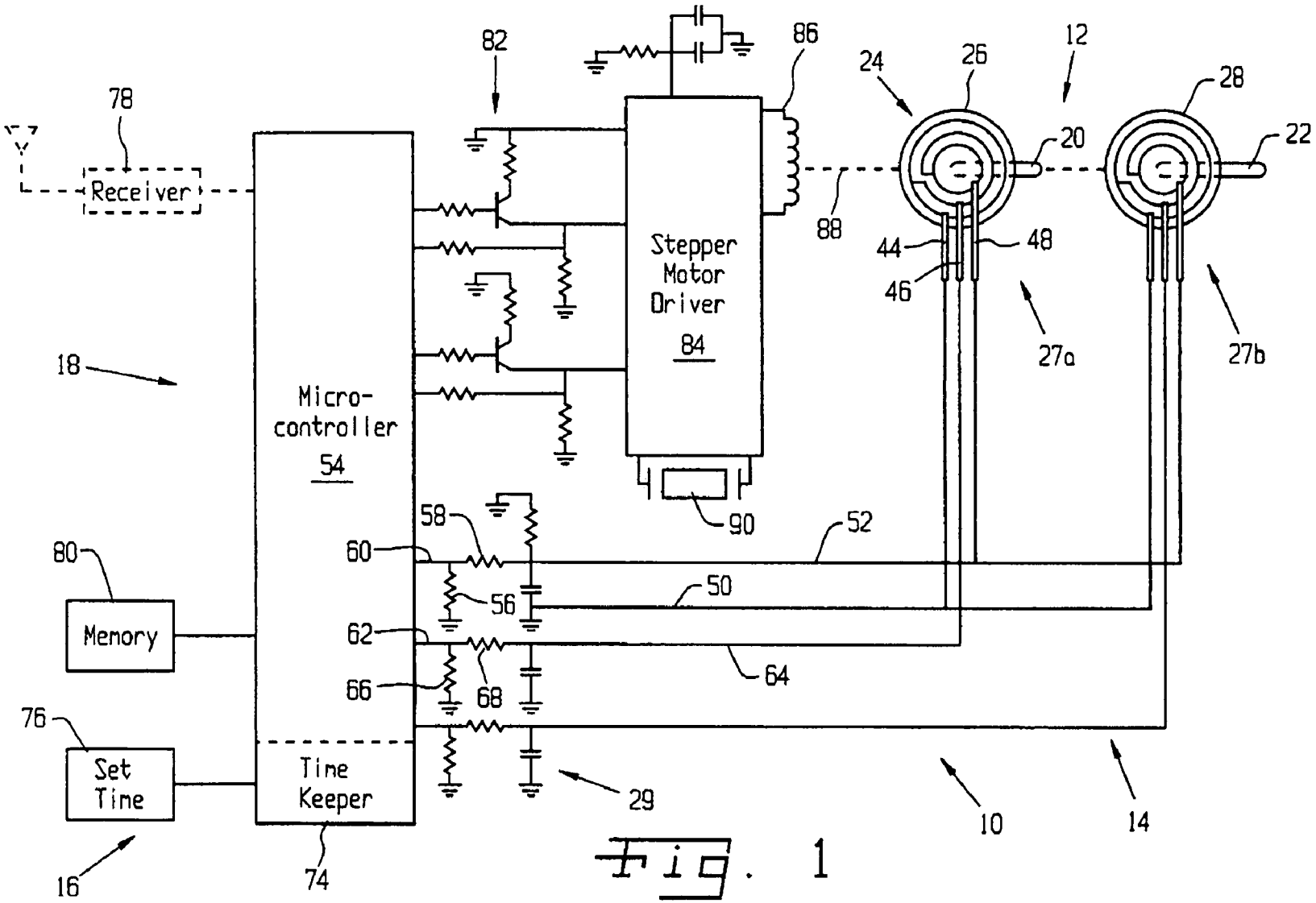
FIG. 1 is a schematic diagram of one embodiment of a mechanical clock arrangement of the present invention.

Corresponding reference characters indicate corresponding parts throughout the several views. Although the drawings represent embodiments of the present invention, the drawings are not necessarily to scale and certain features may be exaggerated in order to better illustrate and explain the present invention. The exemplifications set out herein illustrate embodiments of the invention in several forms and such exemplification is not to be construed as limiting the scope of the invention in any manner.

DESCRIPTION OF INVENTION

The embodiments discussed below are not intended to be exhaustive or limit the invention to the precise forms disclosed in the following detailed description. Rather, the embodiments are chosen and described so that others skilled in the art may utilize their teachings.

Referring now to the drawings, and particularly to FIG. 1, there is shown one embodiment of a mechanical clock arrangement 10 of the present invention including a mechanical clock 12, a sensing device 14 for sensing a time of day displayed by clock 12, a source 16 of an actual time of day, and a control device 18. Clock 12 includes an hour hand 20, a minute hand 22, and a linkage 24 for rotatingly driving hands 20, 22. Linkage 24 includes an hour gear 26 that is fixed to hour hand 20, and a minute gear 28 that is fixed to minute hand 22

Sensing device 14 includes potentiometers 27*a*, 27*b* electrically connected to electronic circuitry 29 and respectively associated with hour gear 26 and minute gear 28. Potentiometer 27*a* includes an arcuate resistive element 30, best shown in FIG. 2A, having two opposite ends 32, 34 electrically connected to respective annular terminals 36, 38 via respective connectors 40, 42, which may be in the form of connecting traces. Element 30 and terminals 36, 38 may be affixed to hour gear 26 such that terminal 36 is disposed radially outward of element 30, and terminal 38 is disposed radially inward of element 30.

Terminals 36, 38 and connectors 40, 42 may be formed of an electrically conductive material, such as copper, that has substantially no electrical resistance. Element 30 may be formed of an electrically resistive substance such that element 30 has a measurable resistance between ends 32, 34. In one embodiment, the measurable resistance is approximately between 1000 and 20,000 ohms. Further, the resistivity of element 30 may be substantially consistent throughout the arc formed thereby such that there is an equal resistance across any two sections of the same size within the arc. In one embodiment, element 30 is formed of a resistive ink that may be screen printed on gear 26.

Potentiometer 27*a* also includes three contacts in the form of wipers 44, 46 and 48 slidingly engaged with terminal 36, resistive element 30 and terminal 38, respectively. Wiper 44 may be electrically grounded via a ground line 50. A constant DC voltage from circuitry 29 may be applied to wiper 48 via a power line 52. In one embodiment, the constant DC voltage is approximately between two volts and twenty volts. A microcontroller 54 may receive a scaled down voltage that is representative of the voltage applied to wiper 48. More particularly, through a voltage divider including resistors 56, 58, an input 60 of microcontroller 54 may receive a scaled down version of the voltage applied to wiper 48. Another input 62 of microcontroller 54 may receive, through a line 64 and a voltage divider including resistors 66, 68, a scaled down version of the voltage at wiper 46.

Resistive element 30 is shown in the drawings as forming an arc of approximately 350 degrees. Generally, the resistive element may form an arc of greater than 330 degrees. The span of the arc may be limited such that a gap 70 between ends 32, 34 is larger than a width 72 of wiper 46. Thus, wiper 46 is prevented from possibly providing a short circuit between ends 32, 34.

The structure of potentiometer 27*b* is substantially similar to that of potentiometer 27*a* as described above. Thus, in order to avoid needless repetition, the structure of potentiometer 27*b* is not described in detail herein.

Actual time of day source 16 includes a time keeper section 74 within microcontroller 54. Time keeper 74 may include a high frequency crystal oscillator (not shown), and may be similar to time keeping units in conventional digital clocks. Time keeper 74 may be connected to a set time user interface 76 through which a user may initially set a time of day that time keeper 74 may thereafter increment and maintain. Interface 76 may be in the form of an hour button and a minute button, or may be in the form of one or more dials, as is well known.

In an alternative embodiment, the source of the actual time of day may be a radio frequency receiver 78 that is in communication with controller 54. Receiver 78 may receive a radio frequency signal that includes time of day information. The radio frequency signal may be in the form of a GPS signal, Satellite Digital Audio Receiver (SDAR) signal, Digital Audio Broadcast (DAB) signal, In Band On Channel (IBOC) signal, Vehicle Information and Communication System (VICS) signal, Data Audio Channel (DARC) signal, FM radio signal, AM radio signal, FM-RDS signal, FM-RDBS signal, television signal, or cell phone signal, for example. In the case of a GPS signal, microcontroller 54 may receive not only the time of day, but may also be able to determine through the GPS capabilities what time zone the automobile is in.

Control device 18 is in communication with both sensing device 14 and actual time of day source 16. Control device 18 includes microcontroller 54, a memory device 80 in communication with microcontroller 54, and control circuitry 82 for controlling a stepper motor driver 84, which, in turn, drives a stepper motor 86. Stepper motor 86 is coupled to linkage 24, as indicated by dashed line 88, such that stepper motor 86 may rotate gears 26, 28 and thereby also cause hands 20, 22 to rotate. Stepper motor driver 84 includes a low frequency crystal oscillator 90 that enables motor 86 to drive clock 12 at a time rate of speed that is nearly accurate, but, as discussed above, may be off by approximately 4 seconds per day.

In operation, an output resistance of potentiometer 27*a* depends upon a rotational position of gear 26. Potentiometer 27*a* may have two output resistances, i.e., a resistance between wipers 44, 46 being a first output resistance, and a resistance between wipers 46, 48 being a second output resistance. A sum of these two output resistances may be constant, i.e., the resistance of element 30 between ends 32, 34. The rotational position of gear 26 determines where along arcuate element 30 that wiper 46 makes contact, and this position determines how the end-to-end resistance of element 30 is divided between the first and second output resistances of potentiometer 27*a*. Thus, both a first resistance between terminal 36 and wiper 46 and a second resistance between terminal 38 and wiper 46 are dependent upon a rotational position of gear 26.

Given that a known DC voltage is applied to end 34 of element 30, and end 32 is grounded, the voltage at wiper 46 on line 64 is indicative of the rotational position of gear 26 and hand 20. This voltage at wiper 46 and the known resistance between ends 30, 32 indirectly indicate the resistance between wipers 44, 46, as well as the resistance between wipers 46, 48. The relationship between the rotational position of gear 26 and the ensuing voltage at wiper 46 may be empirically predetermined and stored in memory 80. Alternatively, a desired predetermined relationship between the rotational position of gear 26 and the ensuing voltage at wiper 46 may be created by laser trimming element 30 or by some other resistance adjustment technique. This desired and predetermined relationship between the rotational position of gear 26 and the ensuing voltage at wiper 46 may also be stored in memory 80.

Figure 2A:
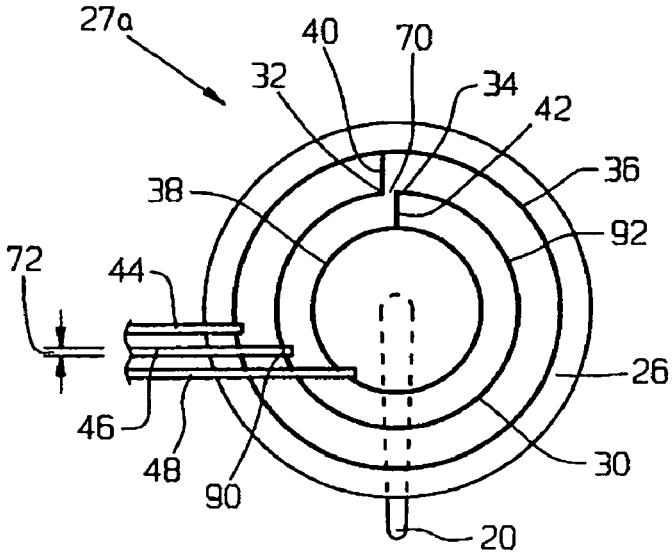
FIG. 2*a* is an enlarged view of the hour gear and associated contacts of the arrangement of FIG. 1.
Figure 2B:
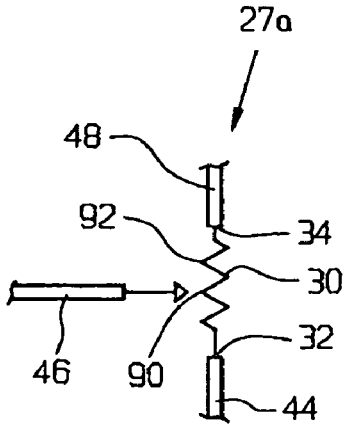
FIG. 2*b* is a schematic representation of the hour gear and associated contacts of FIG. 2*a*.
Figure 3A:
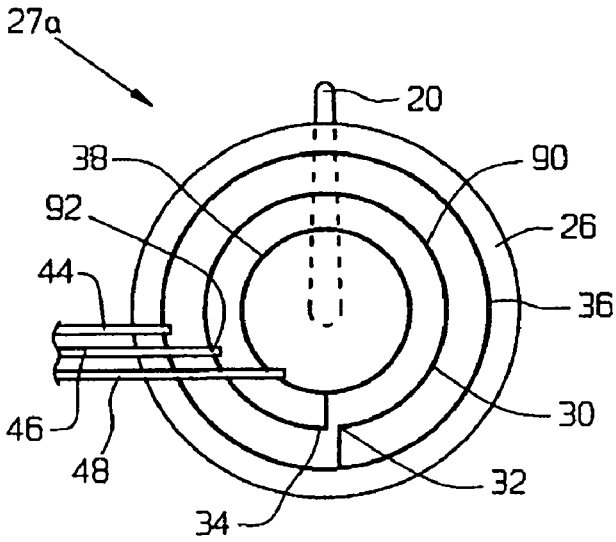
FIG. 3*a* is another enlarged view of the hour gear and associated contacts of the arrangement of FIG. 1 wherein the hour gear is in a position approximately six hours removed from the position of FIG. 2*a*.
Figure 3B:
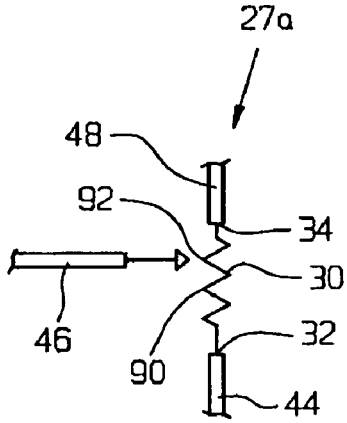
FIG. 3*b* is a schematic representation of the hour gear and associated contacts of FIG. 3*a*.

FIG. 2B illustrates schematically how element 30 is set up as a potentiometer, with wipers 44, 46, 48 functioning as the three terminals of the potentiometer. FIG. 3A illustrates gear 26 in a second position approximately six hours removed from the position depicted in FIG. 2A. That is, in FIG. 3A, gear 26 and hour hand 20 are rotated approximately 180 degrees from their position in FIG. 2A. In FIG. 2A, wiper 46 is closer to end 32 than to end 34, and thus the voltage at wiper 46 may be closer to the ground voltage at end 32 than to the DC voltage applied at end 34. In FIG. 3A, in contrast, wiper 46 is closer to end 34 than to end 32, and thus the voltage at wiper 46 may be closer to the DC voltage applied at end 34 than to the ground voltage at end 32. The movement of wiper 46 along element 30 between FIGS. 2A and 3A is represented in FIGS. 2B and 3B as movement of wiper 46 along the schematically indicated resistor 30. More particularly, wiper 46 is disposed at point 90 on element 30 in FIGS. 2A and 2B, and is disposed at point 92 on element 30 in FIGS. 3A and 3B.

The resistive ink that forms element 30 may be laser trimmed to improve the accuracy or consistency of the resistance of element 30. Whether by laser trimming or by some other resistance adjustment technique, desired relationships may be created between the output resistances of potentiometers 27 and the time of day displayed by mechanical clock 12. Moreover, relationships between the resistances between terminals 36, 38 and wiper 46 may be empirically predetermined, or predetermined via some resistance adjustment technique.

Figure 4:
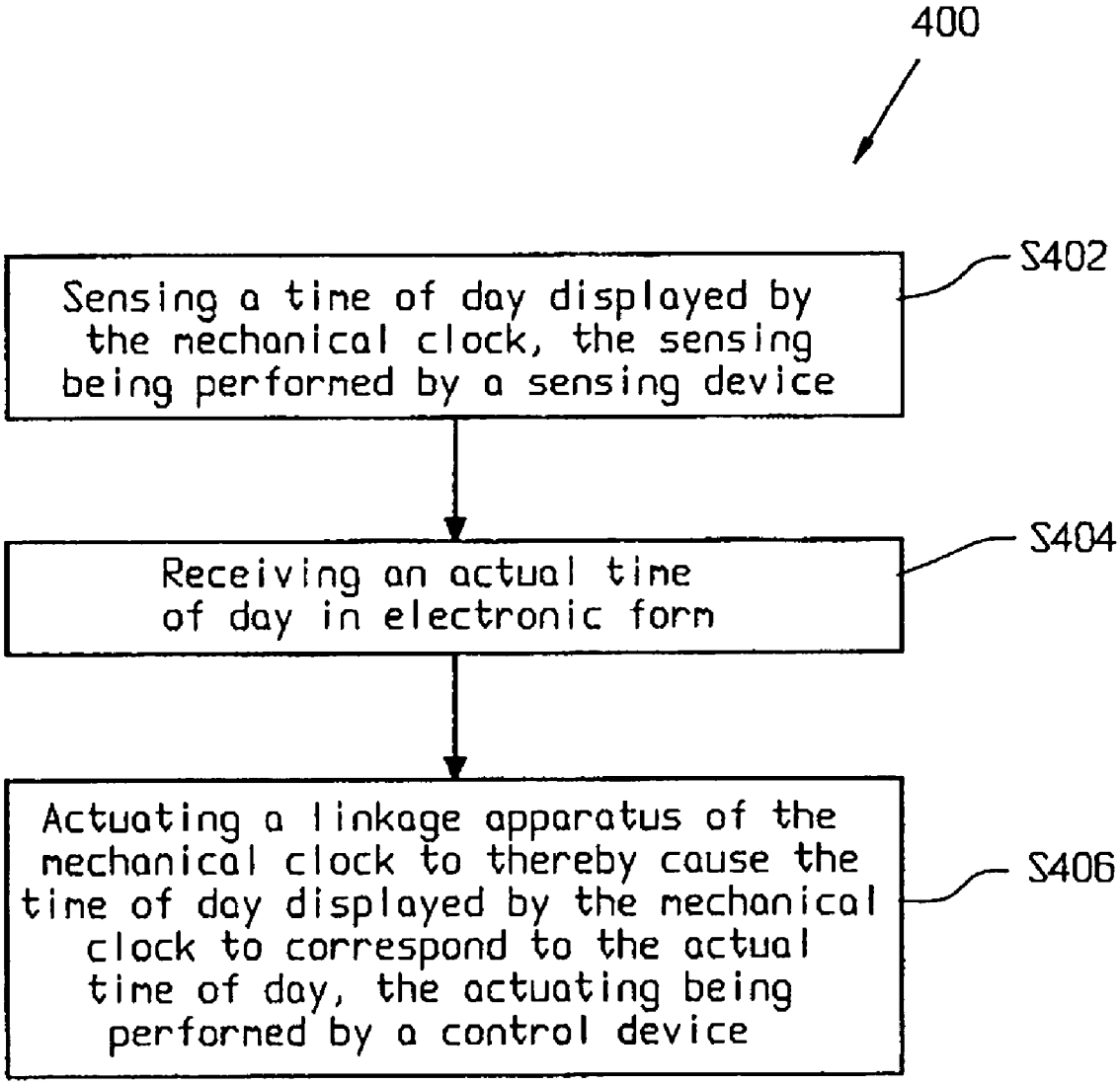
FIG. 4 is a flow chart of one embodiment of a method of operating a mechanical clock of the present invention.

FIG. 4 illustrates a method 400 of the present invention for operating a mechanical clock. In a first step S402, a time of day displayed by mechanical clock 12 is sensed by sensing device 14. For example, by measuring the voltage at wiper 46 with respect to the ground voltage at wiper 44, and by measuring the voltage at the corresponding wiper in potentiometer 27*b* with respect to the grounded wiper in potentiometer 27*b,* sensing device 14 may determine the time of day displayed by clock 12. A predetermined relationship between the voltages at the wipers and the time of day displayed on clock 12 may be retrieved from memory 80 in determining what displayed time of day corresponds to the voltages being read at the wipers. In a next step S404, an actual time of day is received in electronic form. More particularly, control device 18 may receive an actual time of day from time keeper 74. Alternatively, control device 18 may receive an actual time of day from receiver 78, wherein the actual time of day is carried in some radio frequency signal received by receiver 78. In a final step S406, a linkage apparatus of the mechanical clock is actuated by a control device to thereby cause the time of day displayed by the mechanical clock to correspond to the actual time of day. For example, control device 18 may actuate linkage 24 to thereby cause the time of day displayed by clock 12 to correspond to the actual time of day.

Control device 18 may compare the displayed time of day to the actual time of day to determine by how much hands 20, 22 need to be incremented or decremented to display the actual time of day. Microcontroller 54 may then transmit signals to stepper motor driver 84 via circuitry 82 to thereby cause stepper motor 86 to increment or decrement gears 26, 28 and respective hands 20, 22 to the actual time of day.

In order to simplify the illustration, stepper motor 86 is shown in FIG. 1 as being directly coupled to gears 26, 28. However, it is to be understood that linkage 24 may include one or more intermediate gears between stepper motor 86 and hour gear 26 and minute gear 28.

Figure 5A:
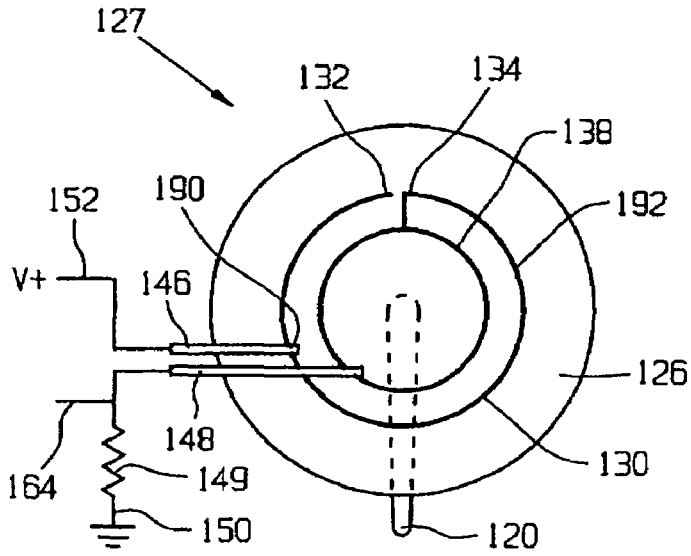
FIG. 5*a* is an enlarged view of another embodiment of an hour gear and associated contacts that may be used in a mechanical clock arrangement of the present invention.

Another embodiment of a potentiometer 127 that may be used in a mechanical clock arrangement of the present invention is illustrated in FIG. 5A. Instead of having two terminals on opposite ends of a resistive element, as with potentiometers 27*a,* 27*b,* potentiometer 127 has only a single terminal 138 electrically connected to an end 134 of arcuate resistive element 130. An opposite end 132 of element 130 is open circuited. Although potentiometer 127 is shown in FIG. 5A as being attached to an hour gear 126 fixed to an hour hand 120, potentiometer 127 is also suitable for attachment to a minute gear.

A wiper 146 is slidingly connected to element 130. A DC voltage may be applied to wiper 146 via a power line 152. In one embodiment, the voltage may be approximately between two volts and twenty volts. A second wiper 148 is slidingly connected to terminal 138. Wiper 148 may be connected to ground potential through a resistor 149 and a ground line 150. In one embodiment, the resistance of resistor 149 may be close to the resistance of element 130, e.g., approximately between 1000 and 20,000 ohms. The voltage at wiper 148 may be measured by a microcontroller (not shown) via line 164 and possibly via associated circuitry (not shown).

As hour gear 126 rotates, the arcuate span between end 134 and wiper contact 146 changes, thereby changing the resistance between wipers 146, 148. The combination of the resistance between wipers 146, 148 and resistor 149 forms a voltage divider for dividing the V+ voltage at power line 152. Thus, the measured voltage at line 164 also varies with the rotation of gear 126, and the rotational position of gear 126 may be ascertained by examining the voltage at line 164.

Figure 5B:
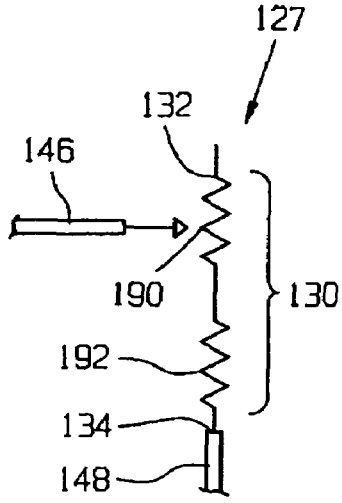
FIG. 5*b* is a schematic representation of the hour gear and associated contacts of FIG. 5*a*.
Figure 6A:
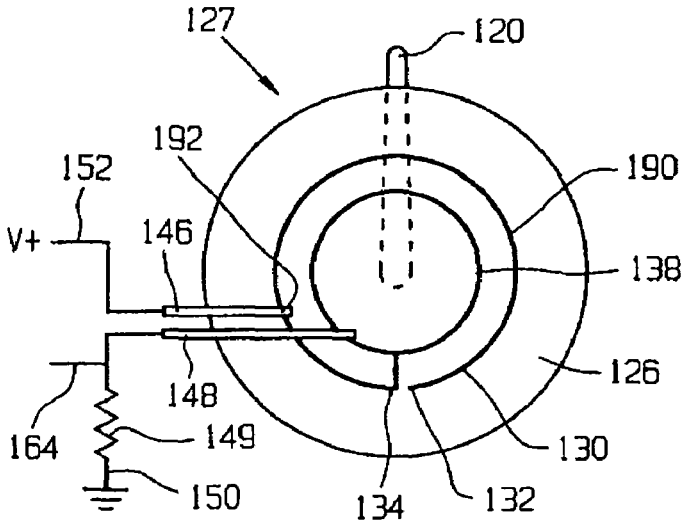
FIG. 6*a* is another enlarged view of the hour gear and associated contacts of FIG. 5*a* wherein the hour gear is in a position approximately six hours removed from the position of FIG. 5*a*.
Figure 6B:
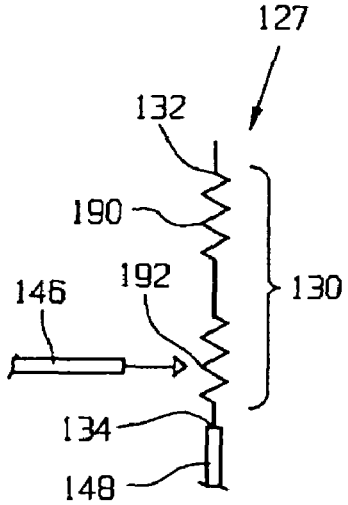
FIG. 6*b* is a schematic representation of the hour gear and associated contacts of FIG. 6*a*.

FIG. 5B illustrates schematically how element 130 is set up as a potentiometer, with wipers 146, 148 functioning as two of the three terminals of the potentiometer. FIG. 6A illustrates gear 126 in a second position approximately six hours removed from the position depicted in FIG. 5A. That is, in FIG. 6A, gear 126 and hour hand 120 are rotated approximately 180 degrees from their position in FIG. 5A. In FIG. 5A, wiper 146 is closer to end 132 than to end 134, and thus the voltage at wiper 146 will be closer to the V+voltage at end 132 than to the scaled voltage applied at end 134. In FIG. 6A, in contrast, wiper 146 is closer to end 134 than to end 132, and thus the voltage at wiper 146 will be closer to the DC voltage applied at end 134 than to the ground voltage at end 132. The movement of wiper 146 along element 130 between FIGS. 5A and 6A is represented in FIGS. 5B and 6B as movement of wiper 146 along the schematically indicated resistor 130. More particularly, wiper 146 is disposed at point 190 on element 130 in FIGS. 5A and 5B, and is disposed at point 192 on element 130 in FIGS. 6A and 6B.

Resistive element 130 and resistor 149 conjointly form a voltage divider, with element 130 being connected to V+ voltage and resistor 149 being connected to ground voltage. However, in another embodiment (not shown), a voltage divider is formed by element 130 being connected to ground voltage and resistor 149 being connected to V+ voltage. Moreover, although potentiometer 127 is set up such that wiper 146 is at a higher voltage than wiper 148, it is also possible to set up the potentiometer such that wiper 148 is at a higher voltage than wiper 146.

Other details of the structure and function of potentiometer 127 are substantially similar to those of potentiometer 27*a* as disclosed above, and thus are not described in detail herein.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

The invention claimed is:

1. A mechanical clock arrangement, comprising:

a linkage apparatus configured to rotatingly drive at least one of an hour hand and a minute hand of a mechanical clock including a gear coupled to and configured to rotate along with at least one of the minute hand and the hour hand;

a sensing device configured to sense a time of day displayed by the mechanical clock, said sensing device including a potentiometer coupled to said gear such that an output resistance of said potentiometer is dependent upon a rotational position of said gear, said potentiometer including an arcuate resistive element and a first electrical contact slidingly engaged with said resistive element, one of said resistive element and said contact being configured to rotate along with said gear;

a source of an actual time of day; and a control device in communication with both said sensing device and said source of an actual time of day, said control device being configured to actuate said linkage apparatus to thereby cause the time of day displayed by the mechanical clock to correspond to the actual time of day.

2. The arrangement of claim 1 wherein said arcuate resistive element has a first end connected to a first terminal, a resistance between said terminal and said contact being dependent upon the rotational position of said gear.

3. The arrangement of claim 2 wherein said arcuate resistive element comprises an arc of greater than 330 degrees affixed to said gear, said terminal being annular and affixed to said gear.

4. The arrangement of claim 2 wherein the resistance between said terminal and said contact has a predetermined relationship with the rotational position of said gear.

5. The arrangement of claim 2 wherein said potentiometer includes a second electrical contact slidingly engaged with said terminal.

6. The arrangement of claim 5 wherein said sensing device is configured to measure at least one of a resistance and a voltage between said first and second contacts.

7. The arrangement of claim 5 wherein said arcuate resistive element has a second end connected to an annular second terminal affixed to said gear, said potentiometer including a third electrical contact slidingly engaged with said second terminal.

8. The arrangement of claim 7 wherein one of said first terminal and said second terminal is disposed radially inward of said arcuate resistive element, an other of said first terminal and said second terminal being disposed radially outward of said arcuate resistive element.

9. The arrangement of claim 1 wherein said control device includes a stepper motor.

10. A method of operating a mechanical clock, comprising the steps of:

sensing a time of day displayed by the mechanical clock, said sensing being performed by a sensing device, wherein said sensing step includes measuring an output resistance of a potentiometer coupled to a linkage apparatus, wherein said potentiometer includes an arcuate resistive element, said sensing step including slidingly engaging a first electrical contact with said resistive element;

receiving an actual time of day in electronic form; and actuating a linkage apparatus of the mechanical clock to thereby cause the time of day displayed by the mechanical clock to correspond to the actual time of day, said actuating being performed by a control device.

11. The method of claim 10 wherein said arcuate resistive element has an end connected to a terminal, said method comprising the further step of slidingly engaging a second electrical contact with said terminal.

12. The method of claim 11 wherein said sensing step includes measuring at least one of a resistance and a voltage between said first and second contacts.

13. The method of claim 10 comprising the further step of trimming said arcuate resistive element to thereby create a desired relationship between the output resistance of said potentiometer and the time of day displayed by the mechanical clock.

14. The method of claim 10 comprising the further step of predetermining a relationship between the output resistance of said potentiometer and the time of day displayed by the mechanical clock.

15. The method of claim 14 comprising the further step of storing the predetermined relationship in a memory device.

16. The method of claim 10 wherein said receiving step comprises receiving the actual time of day in a radio frequency signal.

* * * * *